United States Patent [19]

Barner

[11] Patent Number: 5,064,202

[45] Date of Patent: Nov. 12, 1991

[54] BROADHEAD GUIDE RING FOR AN ARROW

[76] Inventor: Keith Barner, 101 Sunset Blvd., Bozeman, Mont. 59715

[21] Appl. No.: 692,667

[22] Filed: Apr. 29, 1991

[51] Int. Cl.[5] ..... F42B 6/08

[52] U.S. Cl. ..... 273/421; 273/416; 273/423

[58] Field of Search ..... 273/416, 419–423, 273/425

[56] References Cited

U.S. PATENT DOCUMENTS

| | | | |
|---|---|---|---|
| 2,888,264 | 5/1959 | Sharrar et al. | 273/420 |
| 3,982,489 | 9/1976 | Flatau et al. | 273/425 X |
| 4,390,148 | 6/1983 | Cudmore | 273/425 X |

*Primary Examiner*—Paul E. Shapiro
*Attorney, Agent, or Firm*—Richard C. Conover

[57] ABSTRACT

A guide ring for a broadhead encircles an arrow shaft and is frictionally held at the tail edges of the broadhead's blades. The guide ring has a smaller inside diameter at its rearward edge than at its forward edge to deflect air inwardly toward the arrow shaft. The smaller inside diameter is also sized to be larger than the arrow shaft which it encircles to provide space for air to flow between the guide ring and the shaft. Notches on the forward edge of the guide ring frictionally grip the tail edges of the broadhead blades to hold the guide ring in position during the flight of an arrow. When the arrow is in flight, the shape of the guide ring smoothly directs air toward the arrow shaft to increase the airflow past the arrow fletching for increased stability of the arrow. When the broadhead penetrates a target deeper than the tail edge of the blades, the guide ring is forced rearward away from the blades by the target material contacting the forward edge of the guide ring. The guide ring then slides easily backward on the shaft so that it can be repositioned on the blades again whenever the arrow is reused.

2 Claims, 1 Drawing Sheet

BROADHEAD GUIDE RING FOR AN ARROW

BACKGROUND OF THE INVENTION

This invention relates to an improved arrow and in particular to a ring for a broadhead to direct the flow of air around a shaft to improve arrow flight stability.

Conventionally, for centuries arrows have been stabilized with fletching located at the rear of an arrow and aligned with the longitudinal axis of a shaft. An arrow so stabilized flies in a relatively straight path with the fletching aerodynamically bringing the arrow back to the line of flight whenever the arrow is disturbed from this idealized line. Recently attempts to change the aerodynamic flight characteristics of an arrow have been undertaken, but these have generally been limited to specific type airfoils. For instance see U.S. Pat. No. 4,182,513 which has an airfoil having a cross-sectional shape of a wing and located in the center portion of an arrow shaft. This airfoil is used to provide lift and extend the range of an arrow, but this airfoil does not streamline the airflow surrounding the shaft so that more air flows back entirely around the shaft to increase the airflow along all portions of the fletching.

In addition to the airfoil described above, rings have been used on arrowheads in the past to either increase the cutting capacity of the broadhead or to help hold the broadhead blades in position For instance see U.S. Pat. No. 2,888,264 as an example of a ring used to increase the cutting capacity in a wound and U.S Pat. No. 3,756,600 as an example of a ring holding blades in position. Not all archers want to increase the size of a wound however. Neither of the above listed patents illustrate rings that are used for the purpose of deflecting air toward the arrow shaft when the arrow is in flight. These patents also do not illustrate rings that break away from the blades upon target impact to remove the ring from any additional cutting action as the arrow enters the target.

An arrow's flight stability depends upon air flowing smoothly adjacent to the shaft and continuing smoothly along the fletching. A need exists for a broadhead guide ring which can be attached to a conventional broadhead to direct additional airflow inwardly and smoothly against the shaft to increase airflow over the fletching. This increased airflow is used to increase arrow stability. The broadhead guide ring should also be capable of breaking away from its flight position as a broadhead penetrates a target so that the blades enter the target in the conventional manner unimpeded by the guide ring.

SUMMARY OF INVENTION

The present invention relates to a broadhead guide ring for an arrow which is a ring that encircles an arrow shaft and is frictionally held at the tail edges of broadhead blades. The ring has a smaller inside diameter at its rearward edge than at its forward edge to deflect air inwardly toward the shaft. The smaller inside diameter is also sized to be larger than the arrow shaft which it encircles to provide space for air to flow between the ring and the shaft. Notches on the forward edge of the ring frictionally grip the tail edges of the broadhead blades to hold the ring in position during the flight of an arrow. When the arrow is in flight, the aerodynamic shape of the ring smoothly directs air toward the arrow shaft to increase the airflow past the arrow fletching for increased stability of the arrow. When the broadhead penetrates a target deeper than the tail edge of the blades, the ring is forced rearward away from the blades by the target material contacting the forward edge of the ring. The ring then slides easily backward on the shaft so that it can be repositioned on the blades again whenever the arrow is reused.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
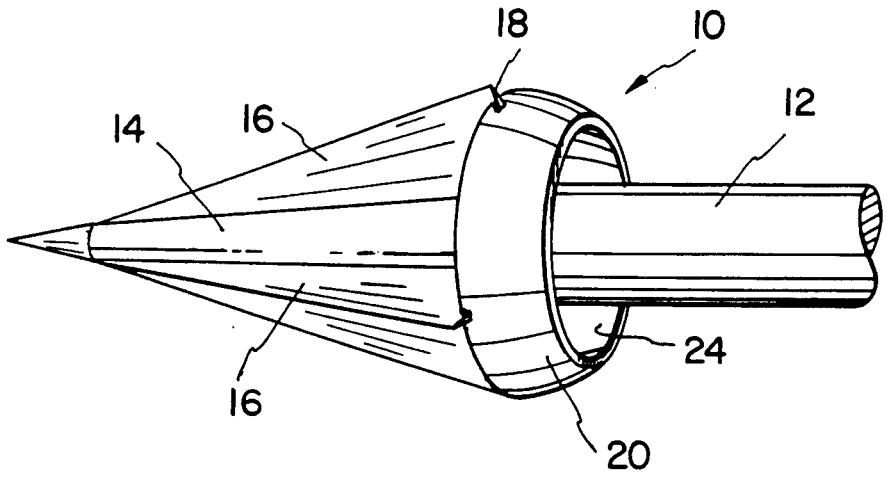
FIG. 1 is a perspective view of the broadhead guide ring according to the present invention mounted to an broadhead.
Figure 2:
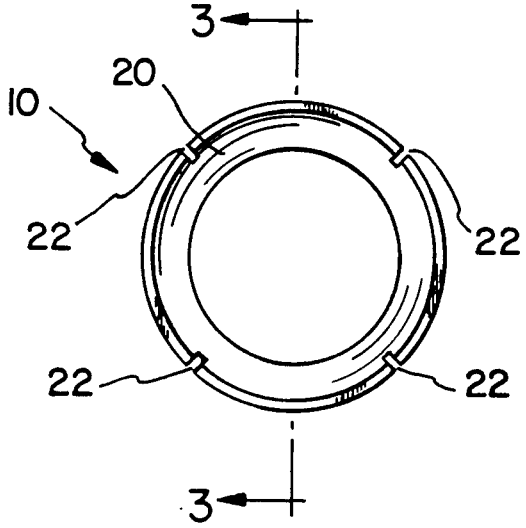
FIG. 2 is a front view of the present invention as shown in FIG. 1.

A preferred embodiment of the broadhead guide ring 10 is shown in FIG. 1. A broadhead 14 is fixedly attached to a head end of a shaft 12 of an arrow. Fletching 15 (not shown) is attached to shaft 12 at a tail end of shaft 12. Broadhead 14 has a plurality of blades 16 extending along the longitudinal axis of the broadhead with each blade having a tail edge 18 that faces the tail end of the shaft 12.

A ring 20 is provided which includes spaced apart notches 22 located on the forward edge which notches are spaced apart to receive the tail edges 18 of all blades 16 on broadhead 14 when the ring is placed in its operable position. The width of the notches are sized to frictionally grip tail edges 18 to keep ring 20 in position during a flight of the arrow. Once broadhead 14 impacts a target, penetration of blades 16 deeper into the target than tail edges 18 will force ring 20 away from the blades.

Figure 3:
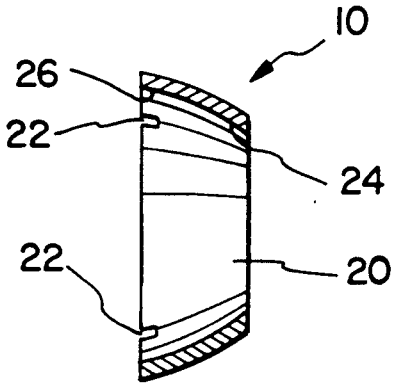
FIG. 3 is a cross-sectional view of the present invention taken along the line 3—3 in FIG. 2.

Ring 20 also has an inside diameter 24 adjacent the rearward edge of the ring that is smaller than inside diameter 26 adjacent the forward edge of the ring. The slanted shape best seen in FIG. 3 is used to direct air flowing through the ring back toward the central axis of the ring. As can best be seen in FIG. 1, smaller inside diameter 24 is sized to be larger than shaft 12 when ring 20 encircles the shaft so that air flowing through the ring is directed smoothly back toward the shaft and completely around the shaft and thence toward the fletching 15. After broadhead 14 strikes a target and ring 20 breaks away from blades 26, the ring easily slides toward the tail end of the shaft where it is held captive on the shaft between the arrowhead and the fletching.

In use, the broadhead guide ring is placed on a shaft 12 either over the fletching or before broadhead 14 is screwed into the forward end of the shaft. Once broadhead 14 is in place with blades 16 fixed at the head end of the shaft 12, notches 22 are then placed around tail edges 18 of blades 16 to hold the ring in position. The arrow is then released normally from a bow. During flight ring 20 smoothly deflects air back along shaft 12 to increase the airflow along the shaft to the fletching 15. As this increased airflow passes the fletching, it provides a greater air mass for the fletching to work against in order to stabilize the arrow.

After the broadhead penetrates a target, ring 20 is forced away from blades 16 by the target material. Ring 20 then hangs loosely in an encircling position as a captive object on shaft 12 caught between the arrowhead and the fletching.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. A broadhead guide ring for use with a broadhead having a blade with a tail edge mounted to an arrow shaft having a forward end and a tail end, the shaft receiving the broadhead at the forward end with the tail edge of the blade facing the tail end, the broadhead guide ring comprising;

a ring encircling the shaft, the ring having a forward edge and a rearward edge;

the ring being shaped to have a smaller inside diameter at the rearward edge than an inside diameter at the forward edge, the smaller inside diameter sized to be larger than the arrow shaft; and a connecting means for connecting the tail edge of the blade to the forward edge of the ring whereby the ring will remain in position on the blade during flight.

2. A broadhead guide ring according to claim 1 wherein the connecting means comprises a notch in the ring for frictionally gripping the blade.

* * * * *